United States Patent [19]

Wren

[11] Patent Number: 4,967,923

[45] Date of Patent: Nov. 6, 1990

[54] PROTECTIVE APPARATUS FOR COMPRESSED GAS CYLINDERS

[76] Inventor: John F. Wren, 1711- 10th Avenue, SW., Calgary, Alberta, Canada, T3C 0K1

[21] Appl. No.: 347,048

[22] Filed: May 3, 1989

[30] Foreign Application Priority Data

Jan. 19, 1989 [CA] Canada ..... 588685

[51] Int. Cl.[5] ..... B65D 90/04

[52] U.S. Cl. ..... 220/3; 220/408; 220/85 P; 137/382

[58] Field of Search ..... 206/0.6; 220/3, 85 P, 220/85 S, 408; 137/382

[56] References Cited

U.S. PATENT DOCUMENTS

| | | | |
|---|---|---|---|
| 290,285 | 6/1987 | Goode et al. . | |
| 1,267,275 | 5/1918 | Rudischhauser | 137/382 |
| 1,326,768 | 12/1919 | Morgan | 137/382 |
| 2,465,095 | 3/1949 | Harvey | 137/382 |
| 3,323,541 | 6/1967 | Schneider, Jr. et al. . | |
| 3,457,960 | 7/1969 | Yoshimutsu et al. | 220/3 |
| 3,752,192 | 8/1973 | Kleppin | 137/382 |
| 3,776,412 | 12/1973 | Mink . | |
| 3,848,768 | 11/1974 | Griffin . | |
| 4,022,343 | 5/1977 | Richardson . | |
| 4,109,692 | 8/1978 | Brown . | |
| 4,165,019 | 8/1979 | Holder | 220/3 |
| 4,438,764 | 3/1984 | Eppolito . | |
| 4,600,033 | 7/1986 | Baron . | |
| 4,709,831 | 12/1987 | Coplan | 220/3 |
| 4,785,956 | 11/1988 | Kepler et al. | 220/3 |
| 4,802,515 | 2/1989 | Pytryga et al. | 220/3 |
| 4,842,139 | 6/1989 | Kriey | 206/0.6 |

*Primary Examiner*—David T. Fidei

[57] ABSTRACT

A protective apparatus for compressed gas cylinders which preferably includes a molded thermoplastic cylindrical sleeve having a raised shoulder region on its two ends. Each shoulder region of the sleeve is provided with an external thread for engaging a closure cap. The closure caps are likewise molded thermoplastic cylinders having one end wall and thread engaging means on the internal circumference of their open ends. The top closure cap is preferably provided with a carrying handle. One end of the cylindrical sleeve is provided with an end wall having an opening which permits the passage of a compressed gas cylinder valve but inhibits the passage of a compressed gas cylinder.

4 Claims, 2 Drawing Sheets

PROTECTIVE APPARATUS FOR COMPRESSED GAS CYLINDERS

BACKGROUND OF THE INVENTION

The present invention relates to compressed gas cylinders, and in particular to a novel apparatus for protecting such cylinders during storage and use.

Protective apparatus for compressed gas cylinders are known in the art. One general style of apparatus of this type is characterized by a metallic cage which surrounds at least the bottom and sides of a compressed gas cylinder. This style of protective apparatus is exemplified in U.S. Pat. Nos. 4,109,692 and 4,438,764. Another style of protective apparatus, designed especially for scuba diving tanks and the like, includes a pair of opposing end caps which are secured to a compressed gas cylinder by a quick release strap that passes around the length of the cylinder and each respective cap, as described in U.S. Pat. No. 4,022,343.

Increasingly stringent safety regulations for mines, oil drilling rigs, pulp and paper mills and other hazardous work environments often require the on-site storage of compressed oxygen or similar breathable gases for use in emergency situations. Compressed gas cylinders are highly pressurized and are recognized to be hazardous when stored and handled. Although the various prior art apparatus noted above are apparently adequate for the purposes for which they were designed, they are generally unsatisfactory for the long term storage of compressed gas cylinders in hazardous or potentially hazardous environments. Their disadvantages include the facts that they either occupy too much space, are expensive to produce, or do not provide adequate protection for the walls of a gas cylinder. There therefore exists a need for a protective apparatus for compressed gas cylinders which overcomes the disadvantages of the prior art.

SUMMARY OF THE INVENTION

It is an object of the present invention to provide a simple, efficient, protective apparatus for compressed gas cylinders which effectively protects a compressed gas cylinder while occupying minimal storage space.

The preferred embodiment of the present invention effectively protects compressed gas cylinders, including their control valves, from damage due to the mishandling, dropping or tipping of a cylinder.

The preferred embodiment of the invention includes a molded thermoplastic cylindrical sleeve having a raised shoulder region on its two ends. The top of the cylinder is provided with an end wall having an opening which permits the passage of a compressed gas cylinder valve. Each shoulder region of the sleeve is provided with an external thread for engaging a closure cap. The closure caps are likewise molded thermoplastic cylinders having one end wall and thread engaging means on the internal circumference of their open ends. The top closure cap is preferably provided with a carrying handle.

In more general terms, the invention includes a protective apparatus for compressed gas cylinders comprising:

a rigid sleeve having a top wall provided with an opening to permit the passage of a compressed gas cylinder valve, said sleeve having means on its two ends for engaging a removable closure; and a closure for each said end of said sleeve, said closures having a top wall and a depending side wall and at least the top closure having a side wall of a length adequate to prevent the contact of the top of the pressure valve of said compressed gas cylinder with the top wall of said closure.

BRIEF DESCRIPTION OF THE DRAWINGS

The invention will now be described by way of example only and with reference to the following drawings wherein.

DETAIL DESCRIPTION OF THE PREFERRED EMBODIMENT

Figure 1:
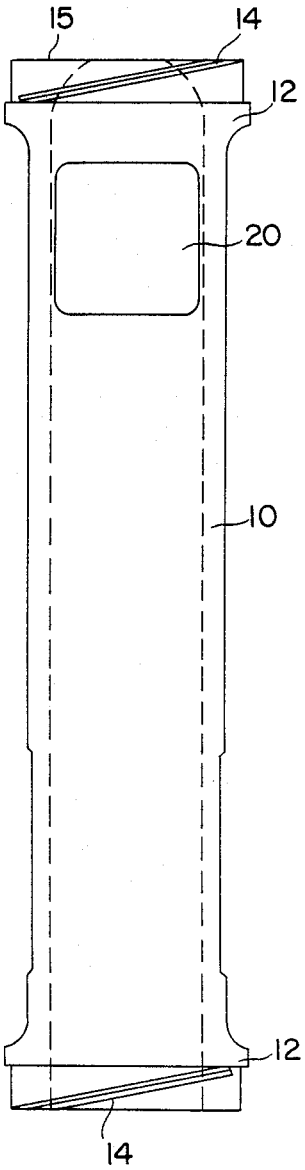
FIG. 1 is a longitudinal cross-section of a protective sleeve for compressed gas cylinders in accordance with a preferred embodiment of the invention.
Figure 2:
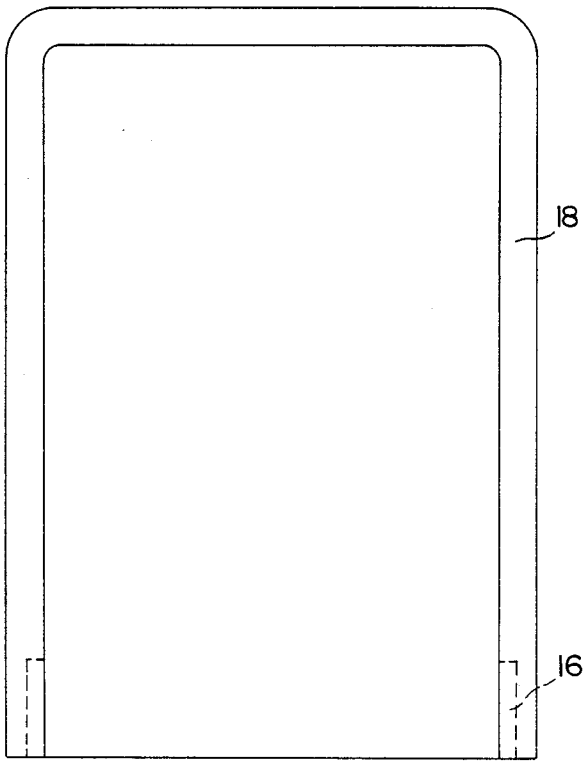
FIG. 2 is a longitudinal cross-section of a typical closure cap for the ends of the protective sleeve of FIG. 1.

As shown in FIG. 1, the invention comprises a thermoplastic cylindrical sleeve 10 having a raised shoulder region 12 on each of its ends. Each shoulder region 12 is provided with an external spiral thread 14 which engages the complementary threads 16 of a closure cap 18 (see FIG. 2). The spiral threads 14 may of course be replaced by lugs, beads or some other type of engagement. In the preferred embodiment illustrated, a window 20 is provided in one side of the cylinder near its top end. The window 20 permits the display of the identification label of a compressed gas cylinder.

Figure 3:
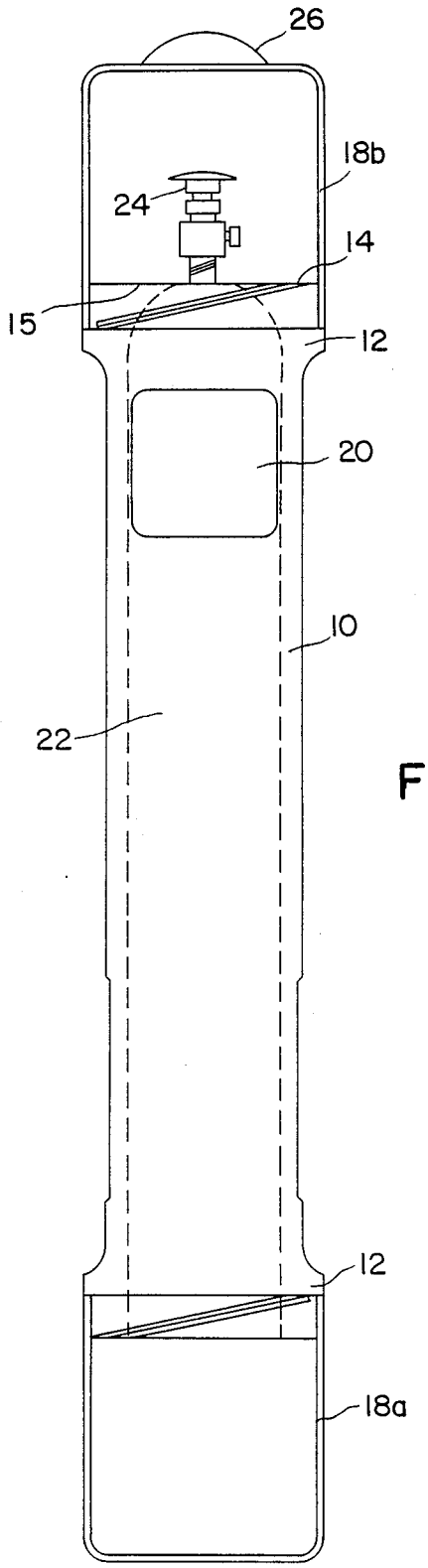
FIG. 3 is a schematic view of the protective sleeve of FIG. 1 and the closure caps of FIG. 2 in their assembled condition and containing a compressed gas cylinder.

FIG. 3 illustrates an embodiment of the invention in its assembled condition with a compressed gas cylinder 22 installed. The compressed gas cylinder 22 is inserted into the protective apparatus by removing the bottom closure cap **18*a* and inserting the cylinder from the bottom of sleeve 10. The sleeve 10 is provided with a top wall 15 which includes an opening to permit the passage of a compressed gas cylinder valve. The inside surface of the top wall 15 is preferably contoured to the shape of the top shoulder region of a compressed gas cylinder. Thus a gas cylinder cannot move beyond the top wall of the cylindrical sleeve 10 and the cylinder valve 24 is protected whenever the top closure 18*b* is attached to the cylindrical sleeve. The inside walls of sleeve 10 are preferably dimensioned to a radius which frictionally engages the outer periphery of the compressed gas cylinder 22. The frictional engagement normally maintains the cylinder in the position shown in FIG. 3. If, due to unusually rough handling, the gas cylinder 22 becomes dislodged from the position shown in FIG. 3, the cylinder may descend to the bottom of the lower closure cap 18*a***, however, the gas cylinder valve is nevertheless protected from contact with any surface within the cylindrical sleeve.

The top closure cap **18*b* is preferably provided with a carrying handle 26. The handle 26 may be constructed from any convenient material including polyurethane. It may be molded integrally with the closure cap 18*b*. Alternatively, it may be constructed as an independent handle which is heat welded or mechanically attached to the closure cap 18. The handle 26** provides a convenient means of handling the compressed gas cylinder protector.

In order to provide superior protection for compressed gas cylinders, the entire apparatus of the invention is preferably injection molded from high density polyurethane having a hardness of 95 Shore "A". This material has the feature of withstanding temperatures from −63° to +122° degrees celsius without deterioration. It is also very resistant to puncture or crushing forces. The protective apparatus of the invention is preferably constructed form a polyurethane which has been treated with an ultraviolet light inhibitor to retard the deleterious effects of sunlight. Because polyurethane is impervious to the action of most chemicals and petroleum products, a protective apparatus for compressed gas cylinders manufactured in accordance with the invention is suitable for use in practically any work environment.

Changes and modifications in the specifically described embodiments can be carried out without departing from the scope of the invention which is intended to be limited only by the scope of the appended claims.

The embodiments of the invention in which an exclusive property or privilege is claimed are defined as follows:

1. A protective apparatus for compressed gas cylinders comprising:

a cylindrical sleeve having a top wall provided with an opening to permit the passage of a compressed gas cylinder valve, said sleeve having engagement means on its two ends for engaging a removable closure; and a closure for each said end of said sleeve, said closure having an end wall and a depending side wall, and at least the top closure having a side wall of a length adequate to prevent the contact of the pressure valve of a compressed gas cylinder with the end wall of said closure.

2. A protective apparatus for compressed gas cylinders as in claim 1 wherein said sleeve and said closures are constructed from a high density polyurethane.

3. A protective apparatus for compressed gas cylinders as in claims 1 or 2 further provided with a window in the wall of said sleeve to permit the display of the identification label of a compressed gas cylinder.

4. A protective apparatus for compressed gas cylinders as in claims 1 or 2 further provided with a carrying handle affixed to one of said closures.

* * * * *